US009046268B2

(12) United States Patent
Condit et al.

(10) Patent No.: US 9,046,268 B2
(45) Date of Patent: Jun. 2, 2015

(54) METHODS FOR SYNCHRONIZING A COUNTDOWN ROUTINE OF A TIMER KEY AND ELECTRONIC DEVICE

(71) Applicant: Battelle Energy Alliance, LLC, Idaho Falls, ID (US)

(72) Inventors: Reston A. Condit, Idaho Falls, ID (US); Michael A. Daniels, Idaho Falls, ID (US); Gregory P. Clemens, Idaho Falls, ID (US); Eric S. Tomberlin, Idaho Falls, ID (US); Joel A. Johnson, Rigby, ID (US)

(73) Assignee: Battelle Energy Alliance, Idaho Falls, ID (US)

( * ) Notice: Subject to any disclaimer, the term of this patent is extended or adjusted under 35 U.S.C. 154(b) by 0 days.

(21) Appl. No.: 14/252,531

(22) Filed: Apr. 14, 2014

(65) Prior Publication Data

US 2015/0107478 A1 Apr. 23, 2015

Related U.S. Application Data

(62) Division of application No. 12/952,025, filed on Nov. 22, 2010, now Pat. No. 8,701,560.

(51) Int. Cl.

| | |
|---|---|
| ***F42C 9/00*** | (2006.01) |
| ***G04C 11/00*** | (2006.01) |
| ***F23Q 21/00*** | (2006.01) |

(52) U.S. Cl.

CPC ..... *F23Q 21/00* (2013.01)

(58) Field of Classification Search

USPC ..... 102/276, 293, 215; 368/107–109, 1–9, 368/46

See application file for complete search history.

(56) References Cited

U.S. PATENT DOCUMENTS

| | | | |
|---|---|---|---|
| 3,286,632 | A | 11/1966 | Potts, Jr. et al. |
| 3,752,081 | A | 8/1973 | McKeown et al. |
| 3,890,900 | A | 6/1975 | Gould et al. |
| 4,041,865 | A | 8/1977 | Evans et al. |
| 4,157,069 | A | 6/1979 | Gustafsson et al. |
| 4,217,826 | A | 8/1980 | Young et al. |
| 4,227,461 | A | 10/1980 | Beezley et al. |
| 4,445,435 | A | 5/1984 | Oswald |
| 4,449,939 | A | 5/1984 | Matteson |

(Continued)

OTHER PUBLICATIONS

PCT International Search Report and Written Opinion of the International Searching Authority, mailed Aug. 21, 2008, 8 pages.

*Primary Examiner* — Benjamin P Lee
(74) *Attorney, Agent, or Firm* — TraskBritt

(57) ABSTRACT

A timer key relating to monitoring a countdown time of a countdown routine of an electronic device is disclosed. The timer key comprises a processor configured to respond to a countdown time associated with operation of the electronic device, a display operably coupled with the processor, and a housing configured to house at least the processor. The housing has an associated structure configured to engage with the electronic device to share the countdown time between the electronic device and the timer key. The processor is configured to begin a countdown routine based at least in part on the countdown time, wherein the countdown routine is at least substantially synchronized with a countdown routine of the electronic device when the timer key is removed from the electronic device. A system and method for synchronizing countdown routines of a timer key and an electronic device are also disclosed.

20 Claims, 7 Drawing Sheets

(56) References Cited

U.S. PATENT DOCUMENTS

| | | | |
|---|---|---|---|
| 4,632,031 | A | 12/1986 | Jarrott |
| 4,633,779 | A | 1/1987 | Biggs et al. |
| 4,641,125 | A | 2/1987 | Pesa |
| 4,674,047 | A | 6/1987 | Tyler et al. |
| 5,014,622 | A | 5/1991 | Jullian |
| 5,166,680 | A | 11/1992 | Ganot et al. |
| 5,363,765 | A | 11/1994 | Aikou et al. |
| 5,377,592 | A | 1/1995 | Rode et al. |
| 5,425,570 | A | 6/1995 | Wilkinson |
| 5,435,248 | A | 7/1995 | Rode et al. |
| 5,460,093 | A | 10/1995 | Prinz et al. |
| 5,761,096 | A | 6/1998 | Zakutin |
| 5,832,761 | A | 11/1998 | Chen |
| 5,929,368 | A | 7/1999 | Ewick et al. |
| 6,166,452 | A | 12/2000 | Adams et al. |
| 6,260,483 | B1 | 7/2001 | Snyder |
| 6,385,137 | B1 | 5/2002 | Porter et al. |
| 6,546,873 | B1 | 4/2003 | Andrejkovics et al. |
| 6,603,711 | B2 | 8/2003 | Calace |
| 6,851,369 | B2 | 2/2005 | Hummel |
| 7,123,167 | B2 | 10/2006 | Staniszewski |
| 7,194,959 | B2 | 3/2007 | Bossarte et al. |
| 7,451,700 | B1 | 11/2008 | Land |
| 7,617,775 | B2 | 11/2009 | Teowee |
| 7,650,841 | B2 | 1/2010 | McClure et al. |
| 7,665,401 | B2 | 2/2010 | Ballantine et al. |
| 7,814,833 | B1 | 10/2010 | Land |
| 7,839,302 | B2 | 11/2010 | Staniszewski |
| 8,109,191 | B1 | 2/2012 | Rudakevych et al. |
| 8,134,822 | B2 | 3/2012 | Ballantine et al. |
| 8,161,877 | B1 | 4/2012 | Frickey et al. |
| 8,375,838 | B2 | 2/2013 | Rudakevych et al. |
| 2004/0184354 | A1 | 9/2004 | McDonald |
| 2005/0000382 | A1 | 1/2005 | Hummel et al. |
| 2005/0252403 | A1 | 11/2005 | DeVries et al. |
| 2006/0027119 | A1 | 2/2006 | Bossarte et al. |
| 2007/0125256 | A1 | 6/2007 | Frickey |
| 2008/0276818 | A1 | 11/2008 | Ballantine et al. |
| 2008/0282922 | A1 | 11/2008 | Land |
| 2009/0145321 | A1 | 6/2009 | Russell |
| 2009/0190443 | A1 | 7/2009 | Huizi et al. |
| 2009/0211316 | A1 | 8/2009 | Butler et al. |
| 2010/0117788 | A1 | 5/2010 | Link |
| 2010/0251917 | A1 | 10/2010 | Land |
| 2011/0090765 | A1 | 4/2011 | Brote |
| 2012/0174809 | A1 | 7/2012 | Stewart et al. |

METHODS FOR SYNCHRONIZING A COUNTDOWN ROUTINE OF A TIMER KEY AND ELECTRONIC DEVICE

CROSS-REFERENCE TO RELATED APPLICATIONS

This application is a divisional of U.S. patent application Ser. No. 12/952,025, filed Nov. 22, 2010, now U.S. Pat. No. 8,701,560, issued Apr. 22, 2014, the disclosure of which is hereby incorporated herein in its entirety by this reference. The subject matter of this application is also related to the subject matter of U.S. patent application Ser. No. 11/297,001, filed Dec. 7, 2005, now abandoned, and U.S. Pat. No. 8,161, 877, filed Dec. 3, 2009, and issued Apr. 24, 2012.

GOVERNMENT RIGHTS

This invention was made with government support under Contract Number DE-AC07-051D14517 awarded by the United States Department of Energy. The government has certain rights in the invention.

TECHNICAL FIELD

Embodiments of the present disclosure relate generally to electronic devices operating with a countdown routine, and more specifically, to an apparatus, system, and method for synchronizing a countdown routine of a removable timer key with an electronic device.

BACKGROUND

Many electronic devices have an amount of time during which operation occurs. Some electronic devices, such as a washing machine may have a predetermined amount of time to operate a complete cycle. Other electronic devices, such as an oven or a microwave, may permit a user to set (i.e., program) a time for operation. Some electronic devices may have both predetermined times as well as programmable times set by a user in order to operate. At times, a user may initiate operation of the electronic device and then leave the electronic device.

For example, energetic initiation devices are often employed in military, commercial, and police use. An energetic initiation device is generally configured to initiate (i.e., fire) a wide range of explosive devices, such as shock tubes, blasting caps, and electrically primed cartridges. Such energetic initiation devices may include a countdown circuit that permits a user to program a desired countdown time for the energetic initiation device to fire after the energetic initiation device has been armed. For example, a user can begin the process of a firing by starting the countdown. The user can then retreat to a safe distance during the countdown time.

FIG. 1 illustrates a conventional electronic firing system 100. The conventional electronic firing system 100 includes an initiation device 110 and an arm key 140. The initiation device 110 is configured to initiate (e.g., fire, detonate) an external device (not shown) such as a shock tube, blasting cap, or other explosive device by sending an initiation signal to the appropriate device. The arm key 140 may be configured to engage with, and be removed from, the initiation device 110 through a receptacle 145 of the initiation device 110. The arm key 140 may act as a safe and arm mechanism (e.g., mechanical out-of-line mechanism) with the initiation device 110 such that the initiation device 110 is in a safe position with the arm key 140 inserted in the initiation device 110, and in an armed position with the arm key 140 removed from the initiation device 110. Removal of the arm key 140 may cause the initiation device 110 to enter into a countdown routine to provide a time delay prior to sending the initiation signal.

The initiation device 110 includes a housing 111 configured to house the internal electronics (not shown). The external portion of the housing 111 of the initiation device 110 includes a programming interface 125 and a display 114. Programming interface 125 may include controls (e.g., set button 127, time buttons 129) for a user to set (i.e., program) the countdown time for the conventional electronic firing system 100. For example, in operation a user may hold down the set button 127 while adding minutes and seconds to select a desired countdown time by pressing the appropriate time buttons 129. Holding the set button 127 and pressing the time buttons 129 causes the countdown time displayed on the display 114 to change. If the user releases the set button 127, the countdown time is stored within the initiation device 110 of the conventional electronic firing system 100. The display 114 is configured to show the countdown time during programming. The display 114 may also be configured to show the countdown time as the countdown time changes during a countdown routine.

The initiation device 110 further includes one or more output terminals, such as a shock tube connector 130 and a blasting cap connector 135. The shock tube connector 130 may be configured to couple with a shock tube (not shown) to be fired. The blasting cap connector 135 may be configured to couple with a blasting cap (not shown) to be fired.

In operation, a user may remove the arm key 140 as indicated by arrow 151. Removal of the arm key 140 may initiate the countdown routine based on the countdown time. The countdown time may be set to provide a sufficient time for the user and other personnel to retreat to a safe distance prior to detonation of the appropriate device to be fired. The user may retain the arm key 140 and leave the conventional electronic firing system 100 behind in the firing zone during the countdown routine. The countdown routine may be stopped prior to firing by re-inserting the arm key 140 into the receptacle 145 of the initiation device 110 of the conventional electronic firing system 100. At the end of the countdown routine, the initiation device 110 may send the appropriate initiation signal to the shock tube or the blasting cap.

In some circumstances, the display 114 on the conventional electronic firing system 100 may no longer be visible to the user. For example, the user may retreat to a sufficiently large distance, or behind a barrier, such that the countdown time on the display 114 is not clear or visible. Consequently, personnel may not be aware how much time has elapsed and whether detonation has occurred or is yet to occur. The user may also be unaware if a failure has occurred, as well as if there is sufficient time to re-insert the arm key 140 to stop the countdown routine prior to generation of the initiation signal.

BRIEF SUMMARY

An embodiment of the present disclosure includes a timer key, comprising a processor configured to respond to a countdown time associated with operation of an electronic device, a display operably coupled with the processor, and a housing configured to house at least the processor. The housing has an associated structure configured to engage with the electronic device to share the countdown time between the electronic device and the timer key. The processor is configured to begin a countdown routine based at least in part on the countdown time, wherein the countdown routine is at least substantially synchronized with a countdown routine of the electronic device when the timer key is removed from the electronic device.

Another embodiment of the present disclosure includes an electronic system, comprising an electronic device and a timer key. The electronic device comprises a timing module configured to perform a countdown routine for operation of the electronic device based at least in part on a set countdown time. The timer key is configured to operably couple with the electronic device in order for the set countdown time to be communicated between the electronic device and the timer key. The timer key comprises a timing module configured to perform and display a countdown routine that is at least substantially synchronized with the countdown routine of the electronic device.

Yet another embodiment of the present disclosure includes a method for monitoring a time of an electronic device. The method comprises operably coupling a timer key with an electronic device, storing a countdown time in at least one of the electronic device and the timer key, wherein the countdown time corresponds to a period of time for a countdown routine of the electronic device, transmitting the countdown time to the other of the electronic device and the timer key, initiating a countdown routine of the electronic device and a countdown routine of the timer key at least at a substantially synchronized time, and displaying the countdown time for the countdown routine of the timer key on a display of the timer key.

DETAILED DESCRIPTION

Figure 1:
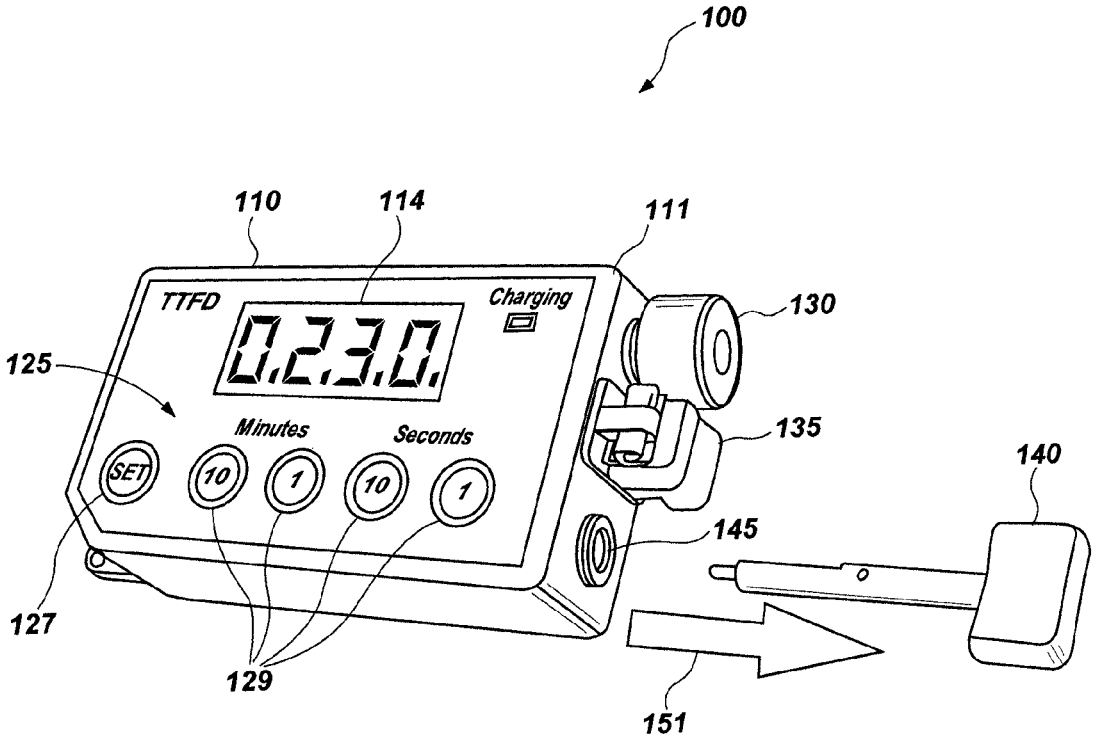
FIG. 1 (PRIOR ART)
FIG. 1 illustrates a conventional electronic firing system.

In the following detailed description, reference is made to the accompanying drawings which form a part hereof and, in which is shown by way of illustration, specific embodiments in which the disclosure may be practiced. These embodiments are described in sufficient detail to enable those of ordinary skill in the art to practice the disclosure, and it is to be understood that other embodiments may be utilized, and that structural, logical, and electrical changes may be made within the scope of the disclosure.

In this description, functions may be shown in block diagram form in order not to obscure the figures with unnecessary detail. Furthermore, specific implementations shown and described are only examples and should not be construed as the only way to implement the present disclosure unless specified otherwise herein. It will be readily apparent to one of ordinary skill in the art that the various embodiments of the present disclosure may be practiced by numerous other partitioning solutions. For the most part, details concerning timing considerations, and the like, have been omitted where such details are not necessary to obtain a complete understanding of the present disclosure in its various embodiments and are within the abilities of persons of ordinary skill in the relevant art.

The various illustrative logical blocks, modules, and circuits described in connection with the embodiments disclosed herein may be implemented or performed with a general purpose processor, a special purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

In addition, it is noted that the embodiments and portions thereof may be described in terms of a process that is depicted as a flowchart, a flow diagram, a structure diagram, or a block diagram. Although a flowchart may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or a combination thereof. When executed as firmware or software, the instructions for performing the methods and processes described herein may be stored on a computer-readable medium. A computer-readable medium includes, but is not limited to, magnetic and optical storage devices such as disk drives, magnetic tape, CDs (compact discs), DVDs (digital versatile discs or digital video discs), and semiconductor devices such as RAM, DRAM, ROM, EPROM, and Flash memory. A computer-readable medium may be located onboard the processor.

Referring in general to the following description and accompanying drawings, various embodiments of the present disclosure are illustrated to show their structures and methods of operation. Common elements of the illustrated embodiments may be designated with like reference numerals. It should be understood that the figures presented are not meant to be illustrative of limiting views of any particular portion of the structure or method, but are merely idealized representations employed to more clearly and fully depict the present disclosure defined by the claims below.

Embodiments of the present disclosure relate to a timer key to be used in conjunction with an electronic device, such as an energetic initiation device of an electronic firing system. The timer key is configured to synchronize with a countdown time of the electronic device, such that each of the timer key and the electronic device may display a countdown time that is at least substantially synchronized with the other.

A countdown routine, as used herein, refers to a process in which a countdown time changes from a starting point to an ending point of the countdown routine. Generally, the countdown routine begins at the countdown time set during programming, and the countdown time ends at the time value of zero (i.e., 0:00). A countdown routine may be paused or reset by reinserting an arm key into an electronic device during the countdown routine. While a "countdown" routine is referred to herein, embodiments of the present disclosure are not limited to the time literally counting down (i.e., being decremented). It is contemplated that a countdown time may be set, and then the countdown time is internally tracked and displayed as incrementing toward an end point in time. In other words, a countdown routine refers to a period of time for an action to occur or to be delayed from occurring, rather than implying a particular internal organization and display of the countdown time. At times, the terms countdown routine and countdown time may be used interchangeably herein.

Figure 2:
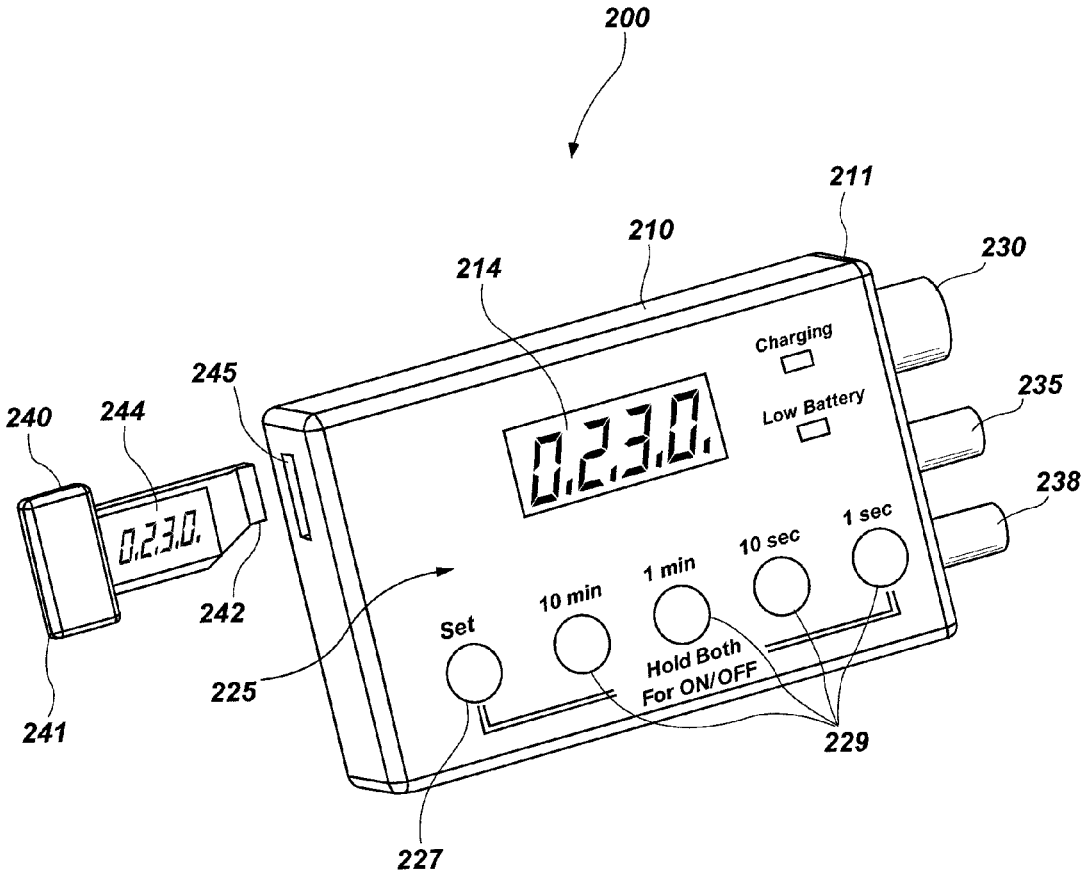
FIG. 2 illustrates an electronic firing system with an energetic initiation device and a timer key according to an embodiment of the present disclosure.

FIG. 2 illustrates an electronic firing system 200 with an energetic initiation device 210 and a removable timer key 240 according to an embodiment of the present disclosure. The energetic initiation device 210 includes a housing 211 configured to house internal components (not specifically shown; see FIGS. 4A and 4B for schematic block diagram) of the energetic initiation device 210. An external portion of the housing 211 may include a display 214 and a programming interface 225. The programming interface 225 includes programming controls, such as a set button 227 and time buttons 229. The energetic initiation device 210 may further include a shock tube connector 230, a blasting cap connector 235, and another device connector 238 configured to couple with an appropriate device (e.g., shock tube, blasting cap, etc.) to be fired.

The removable timer key 240 (also referred to as "timer key") includes a housing 241 configured to house internal components (not shown; see FIGS. 4A and 4B) of the timer key 240. An external portion of the housing 241 may include a display 244. The display 244 of the timer key 240 is configured to display a synchronized version of the countdown time of the energetic initiation device 210. Internal components of the timer key 240 may synchronize the countdown time shown by the display 244 of the timer key 240 with the countdown time shown by the display 214 of the energetic initiation device 210.

The timer key 240 is further configured to engage with the energetic initiation device 210 via receptacle 245 of the energetic initiation device 210. In other words, the housing 241 has an associated structure configured to engage with the energetic initiation device 210 to share the countdown time between the energetic initiation device 210 and the timer key 240. For example, the timer key 240 may include a data connector 242 configured to connect with an internal connector (not shown) and transmit data between the timer key 240 and the energetic initiation device 210. For example, the data connector 242 may be configured as a universal serial bus (USB) connector. Other configurations for engagement of the timer key 240 and the energetic initiation device 210 are also contemplated, such as engaging with a connector external to the housing 211 of the energetic initiation device 210, and by using such data connectors other than a USB connector as are known in the art.

In operation, the energetic initiation device 210 may be configured to permit the user to set a countdown time through the programming interface 225. For example, a user may simultaneously hold the set button 227 and press the time buttons 229 to cause the countdown time displayed on the display 214 to change. If the user releases the set button 227, the countdown time may be stored within the energetic initiation device 210. The display 214 may be configured to show the countdown time during a programming operation. The display 214 may also be configured to show the countdown time as the countdown time changes during a countdown routine.

Releasing the set button 227 may also cause the countdown time to be stored within the timer key 240. For example, the countdown time may be transmitted to, and stored by, the timer key 240. The countdown time for both the energetic initiation device 210 and the timer key 240 may be synchronized, and both the energetic initiation device 210 and the timer key 240 may begin a countdown routine upon removal of the timer key 240. In other words, if the timer key 240 is removed from the energetic initiation device 210, the displays for both the energetic initiation device 210 and the timer key 240 may display the countdown time during the countdown routine.

During the countdown routine, the energetic initiation device 210 may make preparations (e.g., charging a capacitor) for transmitting an initiation signal of a sufficient charge. At the end of the countdown routine, the initiation signal is transmitted through the shock tube connector 230, the blasting cap connector 235, or other device connector 238, or any combination thereof in order to detonate the appropriate connected device. The charging and transmission of the initiation signal may be accomplished, for example, in a manner similar to the process described in U.S. patent application Ser. No. 11/297,001, published as U.S. Patent Application No. 2007/0125256A1, which was filed Dec. 7, 2005 and entitled Electronic Firing Systems for Multiple Firing Devices, the disclosure of which is incorporated herein in its entirety by this reference.

When removed, the user may retain the timer key 240 in order to readily ascertain the status of the countdown time of the energetic initiation device 210 during the countdown routine. As a result, the timer key 240 with the synchronized countdown time displayed on the display 244 permits the user to have a visible countdown timer from a safe distance from the energetic initiation device 210. The user can be aware of when the initiation signal is to be transmitted for detonation to occur. The user may be able to know immediately whether the user has adequate time to stop the countdown process, or whether or not the detonation is supposed to have occurred.

Figure 3:
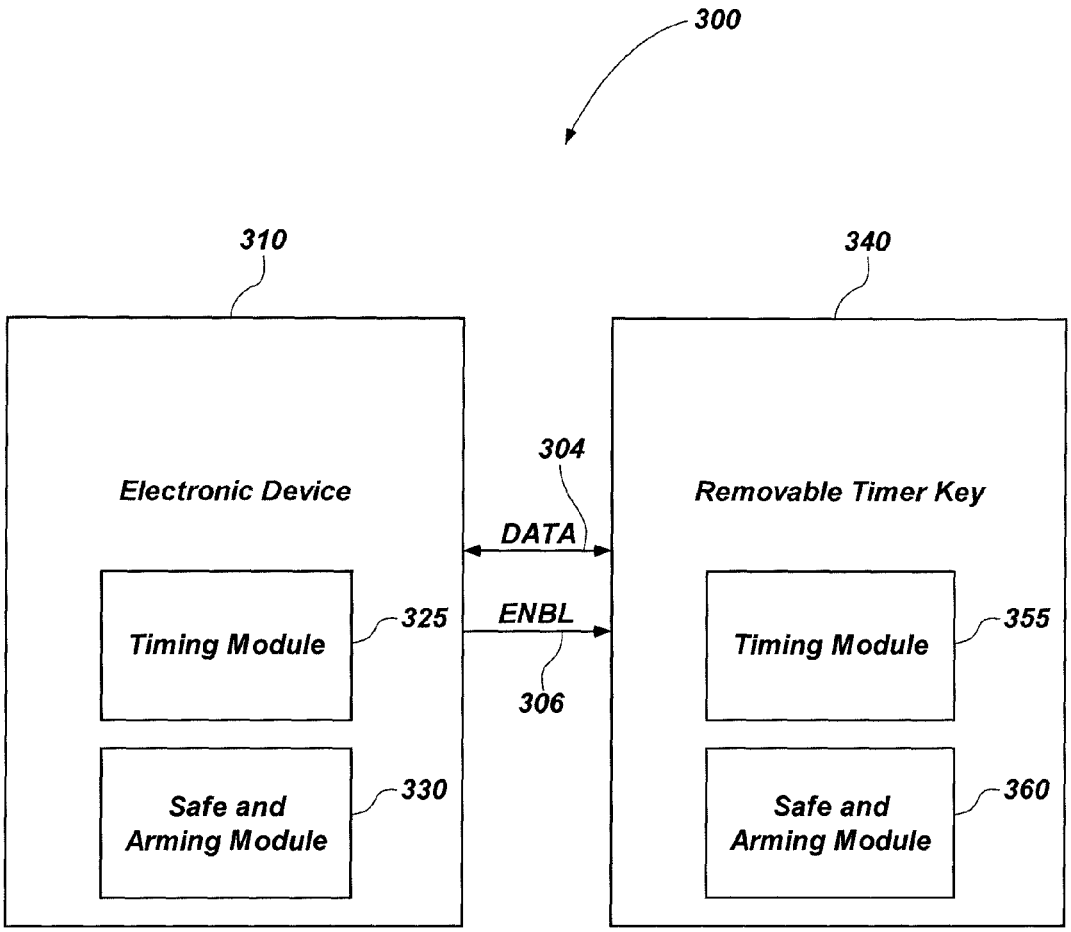
FIG. 3 illustrates a simplified schematic block diagram of an electronic firing system including an electronic device and a removable timer key according to an embodiment of the present disclosure.

FIG. 3 illustrates a simplified schematic block diagram of an electronic firing system 300 including an electronic device 310 and a removable timer key 340 according to an embodiment of the present disclosure. The electronic device 310 includes timing module 325 and safe and arming module 330. The timer key 340 includes timing module 355 and safe and arming module 360.

When coupled together, data signals or other signals may be communicated between the electronic device 310 and the timer key 340. For example, data signals (DATA) 304 may be transmitted (e.g., shared) between the electronic device 310 and the timer key 340. Data signals 304 may include data corresponding to the countdown time for the timing module 325 of the electronic device 310. The data signals 304 may also include acknowledgement signals to confirm that the data signals 304 were properly transmitted and received between the electronic device 310 and the timer key 340. Transmitting the data signals 304 between the electronic device 310 and the timer key 340 may assist in ensuring that the countdown time of the timing module 355 of the timer key 340 is at least substantially synchronized with the countdown time of the timing module 325 of the electronic device 310. For example, the electronic device 310 may include a programming interface 225 (FIG. 2) configured to set and program the countdown time in the electronic device 310, which countdown time may be communicated to the timer key 340. If the timer key 340 is removed from the electronic device 310, the electronic device 310 and the timer key 340 each detect that the devices are no longer coupled with each other. As a result, the countdown routine may begin at least substantially simultaneously in both the electronic device 310 and the timer key 340.

When coupled together, an enable (ENBL) signal 306 may also be communicated between the electronic device 310 and the timer key 340. For example, upon power up, the electronic device 310 may hold the enable signal 306 high such that when coupled with the timer key 340, the timer key 340 may receive the enable signal 304 as an indication that the timer key 340 is coupled with the electronic device 310. In response to receiving the enable signal 306, the timer key 340 may "wake up" from a power saving sleep mode and await receiving the countdown time from the electronic device 310.

The safe and arming module 330 of the electronic device 310 is configured to detect the coupling with the timer key 340. During the time that the electronic device 310 is coupled with the timer key 340, the countdown routine may not begin, and the electronic device 310 may not be operable. In other words, the safe and arming modules 330, 360 interact with each other in order to cause the electronic device 310 to operate in one of a safe mode and an armed mode. The safe and arming modules 330, 360 may also be referred to as an "out-of-line mechanism" or a "mechanical out-of-line mechanism." As an example, if the electronic device 310 is configured as an energetic initiation device, the initiators (e.g., capacitors) may not be charged. An example configuration of the safe and arming module 360 of the timer key 340 includes a magnet 450 (FIGS. 4A and 4B) in conjunction with the safe and arming module 330 of the electronic device 310 including a sensor configured to detect or otherwise respond to a magnetic field. For example, the sensor may be a Hall-effect sensor, a reed switch, or another device sensitive to a magnetic field. As a result, when the timer key 340 is coupled with the electronic device 310, the safe and arming module 330 of the electronic device 310 detects the safe and arming module 360 of the timer key 340. In response to such detection, the safe and arming module 330 of the electronic device 310 may discharge (e.g., short) the initiators of the electronic device 310, disable the initiators, or otherwise prohibit operation of the electronic device 310.

Other configurations of the safe and arming modules 330, 360 are contemplated. For example, the safe and arming modules 330, 360 may be configured as a mechanical switch that is activated and deactivated in order to enable and disable the operation of the electronic device 310 during coupling and decoupling of the electronic device 310 and the timer key 340. Another example may include the timer key 340 including a metal pin, a band, or another metallic shorting device that contacts a switch or a plurality of switches in the electronic device 310, which discharge the capacitors of the electronic device 310 or physically isolate the output mechanisms (i.e., shock tube connector, etc.) from the charging circuit. Another configuration may include a light transmitter with an optical sensor. A light beam may be interrupted by the timer key 340 to indicate the presence of the timer key 340. Alternatively, the safe and arming module 360 of the timer key 340 may include the light transmitter such that the presence of the timer key 340 is indicated when a light beam is received by an optical sensor of the safe and arming module 330 of the electronic device 310. As a result, operation of the electronic device 310 may be responsive to the detection of a light beam.

The safe and arming module 360 (e.g., processor) of the timer key 340 may also send an enable signal to the safe and arming module 330 (e.g., processor) of the electronic device 310 in a similar manner of enable signal 306. In other words, the electronic device 310 may be aware of the presence of the timer key 340 through the reception of an enable signal (not shown) transmitted by the timer key 340. The described methods for arming and disarming the electronic device 310, and for starting and stopping the countdown timers, may be employed in combination. For example, an optical sensor with a light transmitter may be employed in conjunction with a magnetic sensor and a magnet.

Figure 4A:
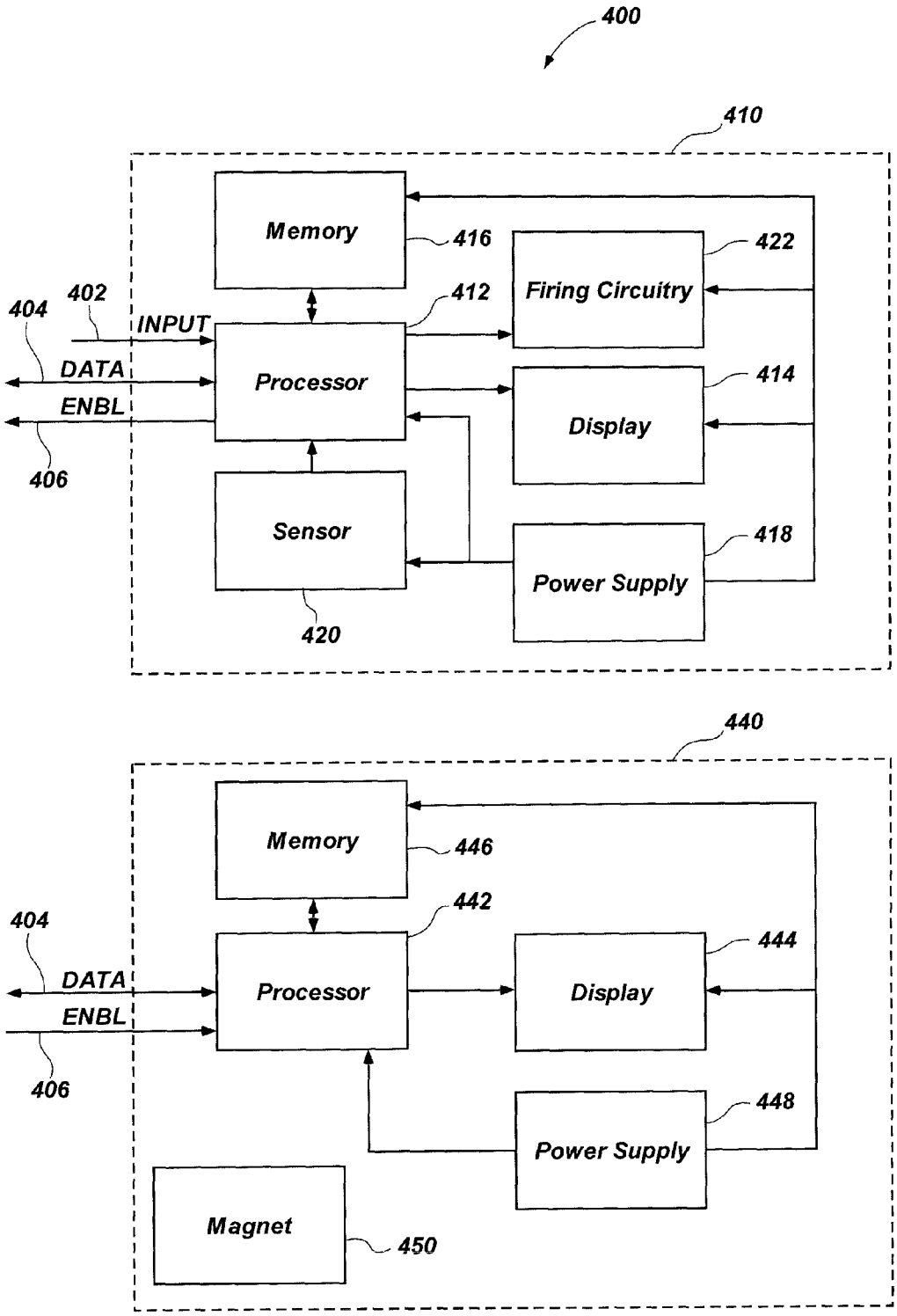
FIG. 4A illustrates a schematic block diagram of a power and communication system of an electronic firing system including an electronic device and a removable timer key according to an embodiment of the present disclosure.

FIG. 4A illustrates a schematic block diagram of a power and communication system of an electronic firing system 400 including an electronic device 410 and a removable timer key 440 according to an embodiment of the present disclosure. For example, the electronic device 410 may be the energetic initiation device 210 of FIG. 2, and the timer key 440 may be the timer key 240 of FIG. 2. The components illustrated in FIG. 4A may include at least some of the internal components that may be housed by the housings 211, 241 described with reference to FIG. 2.

The electronic device 410 may include a processor 412, a display 414, memory 416, a power supply 418, a sensor 420, and firing circuitry 422. The power supply 418 may be coupled to each of the processor 412, display 414, memory 416, sensor 420, and the firing circuitry 422 in order to provide sufficient operating power thereto. The processor 412 is coupled with the display 414, the memory 416, the sensor 420, and the firing circuitry 422. At least one of the processor 412 and the memory 416 may include control logic (not shown) configured to control operation of the electronic device 410.

The timer key 440 may include a processor 442, a display 444, memory 446, a power supply 448, and a magnet 450. The power supply 448 is coupled with each of the processor 442, the display 444, and the memory 446 in order to provide sufficient operating power thereto. The processor 442 is coupled with the display 444 and the memory 446. At least one of the processor 442 and the memory 446 may include control logic (not shown) configured to control operation of the timer key 440. Memory 446 may also include other data related to the operation of the timer key 440. For example, memory 446 may include verification data, such as a password, in order for the electronic device 410 to verify that an authorized timer key 440 has been inserted.

The electronic device 410 and the timer key 440 may be coupled to each other through a data signal (DATA) 404 and an enable (ENBL) signal 406. The electronic device 410 may further receive an input signal 402. The data signal 404 may include data corresponding to the countdown time of the electronic device 410 to synchronize the countdown time between the electronic device 410 and the timer key 440. The enable signal 406 may be a constant signal sent by the electronic device 410 so that the timer key 440 recognizes when the timer key 440 is coupled with the electronic device 410. Thus, if the timer key 440 detects the enable signal 406, the timer key 440 may be "awakened" from a relatively low power sleep mode and be ready to receive data over the data signal 404. The enable signal 406 may be replaced by other methods for the timer key 440 to detect being coupled with the electronic device 410, such as those methods described herein with magnetic and optical sensors, as well as by methods that will be appreciated by those of ordinary skill in the art.

In operation, if the countdown time for the countdown routine is being set, the processor 412 receives the input signal 402 with data corresponding to the desired countdown time. As previously described with reference to FIG. 2, the countdown time may be set through a programming interface 225 of the electronic device (e.g., energetic initiation device 210). Another example may include programming the time within the timer key 440 and then transferring the data from the timer key 440 to the electronic device 410. The countdown time may be stored in memory 416 of the electronic device 410. A default countdown time may be stored in the electronic device 410 to be recalled in the absence of a programmed countdown time being set by the user.

Other programming methods are also contemplated, including, for example, communicating the countdown time to the electronic device 410 through data transmission over wireless communication protocols, and through uploading the time from an external device (e.g., programming key). For example, an external device may couple with one of the electronic device 410 and the timer key 440 for uploading the countdown time. The countdown time may then be shared between the electronic device 410 and the timer key 440. The external device may have a programmable interface. The external device may also have a pre-installed countdown time for uploading to the electronic device 410 and the timer key 440. Programming through coupling with an external device may reduce the electronic components of the electronic device 410, the timer key 440, or both.

If the countdown time is set through the electronic device 410, the processor 412 may communicate with the timer key 440 and transmit data signals 404 to the timer key 440 in order to synchronize the timing data. For example, the processor 412 may automatically transmit the countdown time information to the removable key 440 over the data signal 404 when the set button 227 (FIG. 2) is released. It is also contemplated that the processor 412 may transmit the countdown time information at the occurrence of other events. The countdown time may be stored in memory 446 of the timer key 440.

As previously discussed, the processor 412 may also transmit an enable signal 406 to the timer key 440 in order for the timer key 440 to know when the timer key 440 is coupled with the electronic device 410. As a result, if the timer key 440 is decoupled from the electronic device 410 (e.g., removed from the electronic device 410), the timer key 440 may no longer detect the enable signal 406. If it is determined that the timer key 440 is decoupled from the electronic device 410, the timer key 440 and the electronic device 410 may both begin their respective countdown routines in at least a substantially synchronized manner.

During a countdown routine, the electronic device 410 may display the countdown time. For example, the processor 412 transmits the countdown time to the display 414. The countdown time may be governed in the electronic device 410 by an oscillator (not shown) associated with the processor 412. Likewise, during a countdown routine, the timer key 440 may also display the countdown time. For example, the processor 442 transmits the countdown time to the display 444. The countdown time may be governed in the timer key 440 by an oscillator (not shown) associated with the processor 442.

At the end of the countdown routine, the electronic device 410, may, when configured as an energetic initiator (e.g., FIG. 2), send an initiation signal to a blasting cap, shock tube, or other detonating device through firing circuitry 422. For example, during the countdown routine, the processor 412 may charge the firing circuitry 422 (e.g., a capacitor). At the end of the countdown routine, the processor 412 may switch the firing circuitry 422 (e.g., capacitor) to charge the load (e.g., blasting cap, shock tube, etc.).

The processor 442 and the memory 446 of the timer key 440 are shown in FIG. 4A as being separate blocks; however, processor 442 and memory 446 may be integrated on a single chip. For example, processor 442 may be a microcontroller that includes on-board random-access memory (RAM) or other type of volatile or non-volatile memory. Likewise, the processor 412 and the memory 416 of the electronic device 410 may be integrated on a single chip. Other components and functions may also be integrated and performed on a single chip.

The display 414 of the electronic device 410 and the display 444 of the timer key 440 may be any type of display suitable for displaying the countdown time. For example, the displays 414, 444 may include a liquid crystal display (LCD) or a light emitting diode (LED) display. One example of a suitable LCD display is available from Varitronix Limited of Hong Kong.

The power supply 418 for the electronic device 410 may configured to deliver sufficient power to operate the electronic device 410. For example, the power supply 418 may include a battery, fuel cells, generators, and so forth. The power supply 418 may be configured to draw power from an AC power source, which AC power may be further converted to DC power in powering the electronic circuits.

The power supply 448 for the timer key 440 may be configured to deliver sufficient power to operate the timer key 440. For example, the power supply 448 may include a battery or other power storage devices. Such a battery may be rechargeable such that when the timer key 440 is coupled with the electronic device 410, a coupling link also exists to the power supply 448 in order to charge storage cells therein. For example, the coupling link may be an inductive coupling link. The power supply 448 may also be configured as a capacitor that can be charged for a relatively short-term use. For example, when the timer key 440 is coupled with the electronic device 410, the power supply 418 of the electronic device 410 may couple with the power supply 448 of the removable timer key 440 in order to charge a battery, a capacitor, or any charge storage element included therein. Charging the battery or a capacitor of the power supply 448 of the timer key 440 should not be limited to being chargeable only by coupling with the electronic device 410.

The timer key 440 and the electronic device 410 may be operably coupled through physical connections. For example, the timer key 440 and the electronic device 410 may have mating connectors such as those found on USB devices. Other connectors are contemplated to establish a physical connection for coupling and data transfer as are known in the art. For example, an inter-integrated circuit ($I^2C$) bus may be employed. Additionally, different communication protocols may be employed. Additionally, combinations of different connectors with different communication protocols may be employed. For example, a USB connector may be combined with an $I^2C$ communication protocol. The timer key 440 and the electronic device 410 may also be operably coupled through wireless coupling (FIG. 4B).

As previously described with reference to FIG. 3, an electronic device may include a safe and arming module. An example of such a safe and arming module may include a magnet 450 and a sensor 420 as shown in FIG. 4A. Thus, the timer key 440 may include a magnet 450 embedded in the housing 211 (FIG. 2). If the timer key 440 is inserted into, or in sufficient proximity of the electronic device 410, the magnet 450 may be aligned with the sensor 420. The sensor 420 may detect the magnetic field generated by the magnet 450. As a result, the electronic device 410 may be aware that the timer key 440 is present. If the timer key 440 is removed, the sensor 420 may no longer detect the magnetic field and the electronic device 410 may be aware that the timer key 440 is no longer present. As a result, electronic device 410 may be configured to begin the countdown routine if the magnetic field is no longer detected. As previously discussed, the timer key 440 may begin its countdown routine at least substantially at the same time as the timer key 440 would no longer detect the enable signal 406 after the timer key 440 is removed. As a result, the countdown routines of the electronic device 410 and the timer key 440 may be at least substantially synchronized.

Other safe and arming systems are contemplated to replace, or add to, the magnet 450 and the sensor 420. For example, the timer key 440 may send an enable signal to the electronic device 410 in order for the electronic device 410 to determine that the timer key 440 is present. Such an enable signal may be similar in function to the enable signal 406 but is generated by the timer key 440 and transmitted to the electronic device 410. An optical light source and an optical sensor may be also employed. Other methods are also contemplated for the electronic device 410 and the timer key 440 to determine when they are coupled and when the timer key 440 is removed.

Figure 4B:
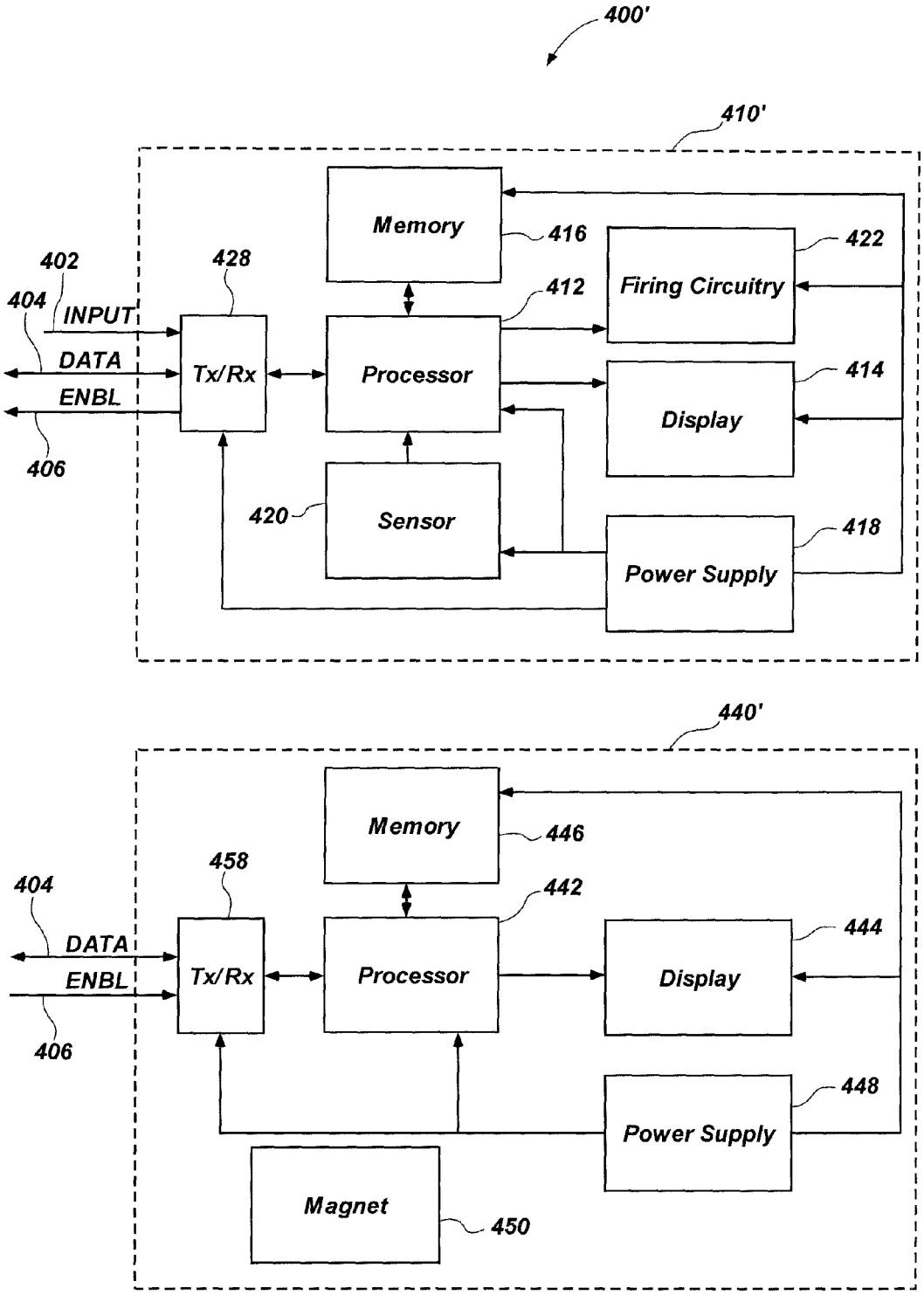
FIG. 4B illustrates a schematic block diagram of a power and communication system of an electronic firing system including an electronic device and a removable timer key according to another embodiment of the present disclosure.

FIG. 4B illustrates a schematic block diagram of a power and communication system of an electronic firing system 400' including an electronic device 410' and a removable timer key 440' according to another embodiment of the present disclosure. The electronic device 410' may include a processor 412, a display 414, memory 416, a power supply 418, a sensor 420, and firing circuitry 422, which components may be coupled and configured in a similar manner as previously described with respect to the electronic firing system 400 of FIG. 4A. The timer key 440' may include a processor 442, a display 444, memory 446, a power supply 448, and a magnet 450, which components may be coupled and configured in a similar manner as previously described with respect to the electronic firing system 400 of FIG. 4A.

The electronic device 410' may further include a transmitter and a receiver (Tx/Rx) 428, and timer key 440' may further include a transmitter and a receiver (Tx/Rx) 458 configured for wireless coupling and data transmission between the electronic device 410' and the timer key 440'. The Tx/Rx 428, 458 are operably coupled with the respective processors 412, 442 and power supplies 418, 448. The Tx/Rx 428, 458 may include a transmitter and a receiver configured separately, or as a single shared device (e.g., transceiver) configured to both transmit and receive a signal. The Tx/Rx 428 of the electronic device 410' and the Tx/Rx 458 of the timer key 440' may be configured to send and receive signals such as the input signal 402, data signals 404, and the enable signal 406. For example, the Tx/Rx 428, 458 may be configured to communicate according to BLUETOOTH®, radio frequency (RF), infrared (IR) communication and other wireless communication standards known in the art.

Communication over the input signal 402, data signals 404, and the enable signal 406 may be accomplished by wired connections, wireless connections, or a combination thereof. For example, the countdown time may be synchronized through a wired connection when the timer key 440' is inserted into a receptacle of the electronic device 410'. When the timer key 440' is removed from the receptacle, there may be an RF override signal in order to communicate information and commands between the timer key 440' and the electronic device 410'. Such an RF override signal may include a command to be sent to the electronic device 410' to abort the countdown and cease preparations for sending an initiation signal.

Figure 5:
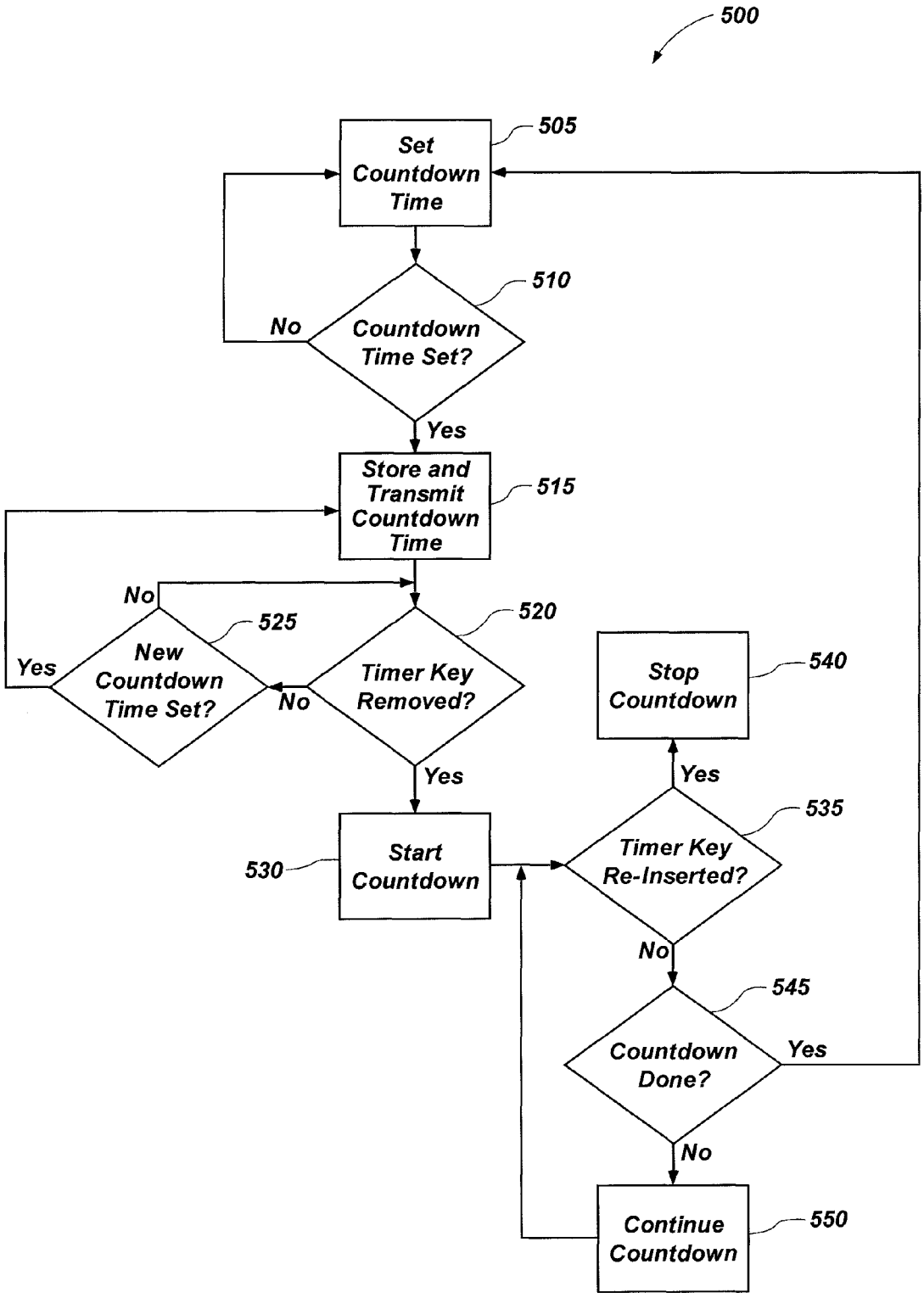
FIG. 5 is a flowchart illustrating a countdown routine of an electronic device according to an embodiment of the present disclosure.

FIG. 5 is a flowchart illustrating a countdown routine 500 of an electronic device according to an embodiment of the present disclosure. At operation 505, the countdown time may be set. For example, a user may input the countdown time through a programming interface 225 (FIG. 2), as previously discussed herein. The programming of the countdown time may also be performed on a device external to the electronic device and then transmitted to the electronic device. At operation 510, a decision is made whether the countdown time has been set. If the countdown time has been set, the countdown routine 500 returns and continues to wait for a countdown time to be set at operation 505. If the countdown time has been set at operation 510, the countdown time may be stored within the electronic device and transmitted to a timer key at operation 515.

At operation 520, a decision may be made as to whether the timer key has been removed. If the timer key has not been removed, then another decision may be made at operation 525. At operation 525, a determination is made whether a new countdown time has been set. If a new countdown time has been set, then the new countdown time is stored and transmitted according to operation 515. If a new countdown time has not been set, then the countdown routine 500 returns to operation 520 to determine whether the timer key has been removed. If the timer key has been removed, then the countdown may start at operation 530. For example, the countdown begins to decrement from the set countdown time until either the timer key is re-inserted or until the countdown expires.

At operation 535, a decision is made whether the timer key has been re-inserted. If the timer key is re-inserted, then the countdown may stop at operation 540. The countdown time may, for example, be reset to the original set countdown time, or the countdown routine 500 may require the user to set the countdown time again. In some embodiments, the countdown routine 500 may pause and then resume from the paused countdown time upon re-removal of the timer key.

Assuming that the timer key is not re-inserted, the countdown routine 500 continues through operations 545 and 550 until the countdown is determined to be completed at operation 545. During the time the countdown time is decrementing (operations 530 through 550), an electronic device configured as an energetic initiation device may be preparing for initiation of the charge, for example, by charging the capacitors to be switched onto the explosive device. When the countdown time has been determined to have expired at operation 545, the electronic device transmits the initiation signal to the explosive device, and detonation occurs.

Figure 6:
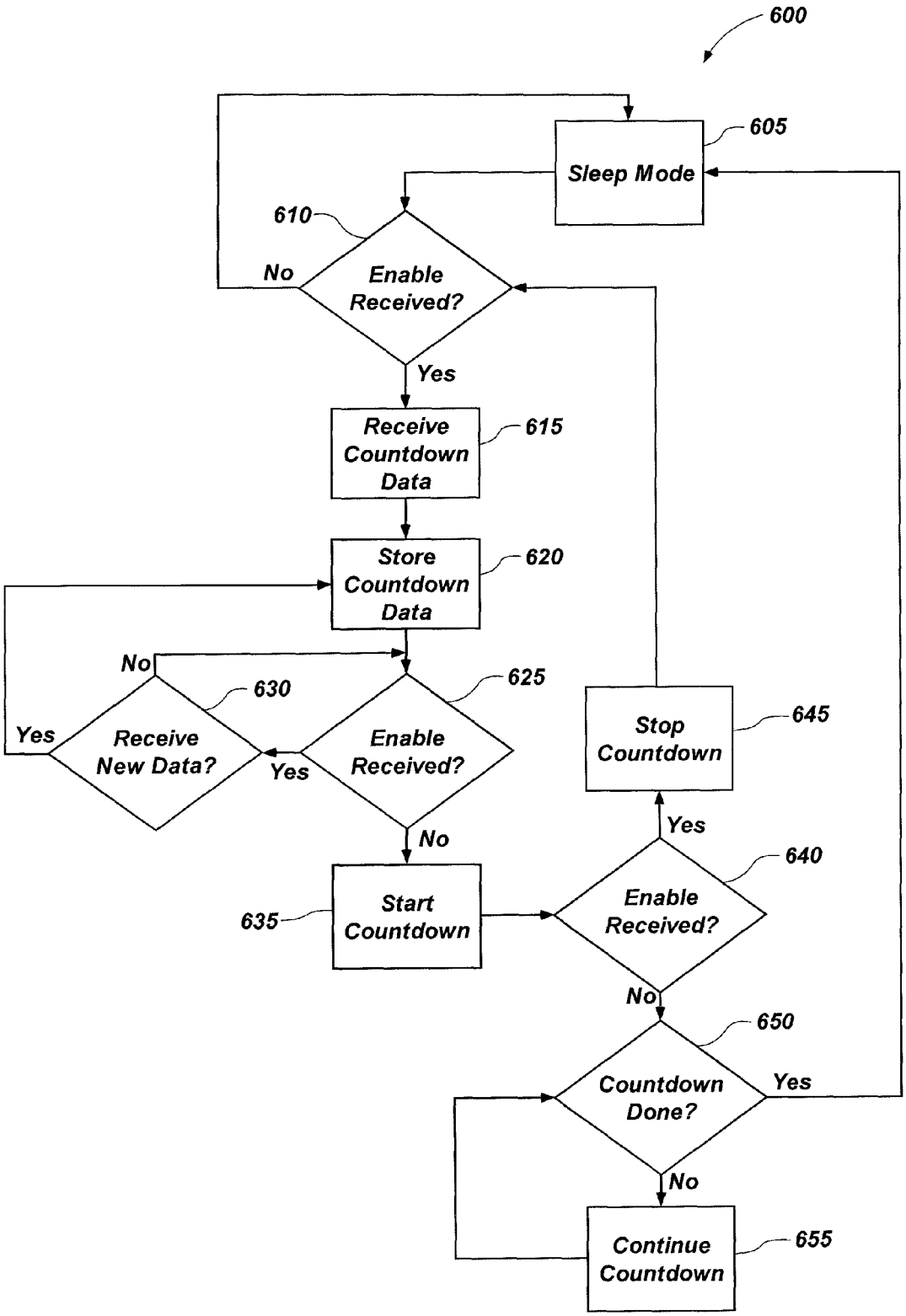
FIG. 6 is a flowchart illustrating a countdown routine of a timer key according to an embodiment of the present disclosure.

FIG. 6 is a flowchart illustrating a countdown routine 600 of a timer key according to an embodiment of the present disclosure. At operation 605, the timer key operates in "sleep mode." Sleep mode may be a relatively low power state in which the components of the timer key operate at a reduced power in order to conserve power. Some components of the timer key may be shut off and not draw any power. The processor 442 (FIG. 4A) of the timer key may monitor for the enable signal transmitted by the electronic device. At operation 610, if the enable signal is received, it is an indication that the timer key is coupled with the electronic device (e.g., has been inserted into the receptacle of the electronic device). The timer key may exit the sleep mode and receives the countdown data at operation 615. At operation 620, the countdown data is stored in the timer key. At operation 625, a determination is made whether the enable signal is still being received. If the enable signal is still being received, then the timer key is configured to continue to monitor for new data being received at operation 630. If new countdown data is received, the new countdown data is stored at operation 620.

If the enable signal is not received, it is an indication that the timer key is no longer coupled with the electronic device. At operation 635, the countdown begins. For example, the countdown begins to decrement from the set countdown time until either the timer key is re-inserted or until the countdown expires. At operation 640, a decision is made whether the enable signal is again received, which reception indicates that the timer key has been re-inserted. If the enable signal is received, then the countdown may stop at operation 645. The timer key may then return to receive countdown data. In some embodiments, the countdown time may pause and then resume from the paused countdown time upon re-removal of the timer key. Assuming that the timer key is not re-inserted, the countdown continues through operations 650 and 655 until the countdown is determined to be completed at operation 650.

While embodiments of the present disclosure have been described as being associated with energetic initiators and electronic firing systems, other applications of a removable timer key are also contemplated. For example, electronic devices may include appliances such as washers, microwaves, ovens, or other electronic devices that operate under a fixed or programmable amount of time. As such, a countdown time may be determined for such electronic devices, which countdown time may be transmitted to a timer key for synchronous operation of the countdown time displayed by the timer key when a user removes the timer key from the electronic device.

While the disclosure is susceptible to various modifications and implementation in alternative forms, specific embodiments have been shown by way of non-limiting example in the drawings and have been described in detail herein. However, it should be understood that the disclosure is not intended to be limited to the particular forms disclosed. Rather, the disclosure includes all modifications, equivalents, and alternatives falling within the scope of the disclosure as defined by the following appended claims and their legal equivalents.

What is claimed is:

1. A method for monitoring a countdown time of an electronic device, the method comprising:

operably coupling a timer key with an electronic device having firing circuitry;

transmitting a countdown time from one of the electronic device and the timer key to the other of the electronic device and the timer key, wherein the countdown time corresponds to a period of time for a countdown routine of the electronic device;

initiating the countdown routine on the electronic device and on the timer key to be at least substantially synchronized;

charging the firing circuitry during the countdown routine;

initiating transmission of a charge responsive to the countdown routine being completed; and displaying the countdown time for the countdown routine of the timer key on a display of the timer key.

2. The method of claim 1, further comprising disabling operation of the electronic device while the timer key and the electronic device are operably coupled.

3. The method of claim 1, wherein initiating the countdown routine occurs responsive to removal of the timer key from the electronic device.

4. The method of claim 1, wherein initiating transmission of a charge includes actuating the firing circuitry and transmitting an explosive charge to an explosive device connected to the electronic device.

5. The method of claim 1, wherein transmitting the countdown time includes transmitting data over a wired communication link established while the timer key and the electronic device are operably coupled.

6. The method of claim 1, wherein transmitting the countdown time occurs automatically responsive to completion of a user programming the countdown time for the electronic device.

7. The method of claim 1, wherein transmitting the countdown time includes transmitting data over a wireless communication link established while the timer key and the electronic device are operably coupled.

8. The method of claim 1, further comprising storing the set countdown time in memory of the timer key after being received from the electronic device.

9. A method of operating an electronic firing system, the method comprising:

setting a countdown time corresponding to a countdown routine in timing modules of an electronic device and in a timing module of a timer key associated with the electronic device by communicating the set countdown time between the electronic device and the timer key;

initiating the countdown routine in the timing modules of the electronic device and the timer key to operate at least substantially synchronized with each other responsive to the timer key being decoupled from the electronic device;

displaying the countdown routine on the timer key;

charging an initiation signal within firing circuitry of the electronic device during operation of the countdown routine; and transmitting the initiation signal from the electronic device to an explosive device responsive to completion of the countdown routine of the electronic device.

10. The method of claim 9, wherein transmitting the initiation signal includes transmitting the initiation signal through at least one of a shock tube connector and a blasting cap connector.

11. The method of claim 9, wherein setting the countdown routine includes:

receiving the set countdown time as a user input via a programming interface of one of the timer key and the electronic device; and transmitting the set countdown time to the other of the timer key and the electronic device.

12. The method of claim 9, further comprising:

transmitting an override signal from the timer key to the electronic device while the countdown routine is in operation; and stopping the countdown routine in the electronic device responsive to the override signal.

13. The method of claim 9, wherein operation of the countdown routine includes decrementing the countdown routine from a starting point toward an end point in time.

14. The method of claim 9, wherein operation of the countdown routine includes incrementing the countdown routine from a starting point toward an end point in time.

15. A method of operating a removable timer key and an electronic device having firing circuitry in a plurality of operational modes, the method comprising:

operating an electronic device having firing circuitry in a safe mode if the timer key is coupled with the electronic device, wherein the safe mode includes setting a countdown time for a synchronized countdown routine of the electronic device and the timer key; and operating the electronic device in an arming mode if the timer key is decoupled from the electronic device, wherein operating the electronic device in the arming mode includes:

initiating the synchronized countdown routine;

charging the firing circuitry of the electronic device during the countdown routine;

displaying the countdown routine on at least the timer key; and initiating an explosive charge responsive to the countdown routine being completed.

16. The method of claim 15, wherein operating the electronic device in between a safe mode and an arming mode is responsive to detecting at least one of a magnetic field, an optical light signal, an enable signal, and a mechanical switch.

17. The method of claim 15, further comprising operating the timer key in a low power sleep mode prior to the timer key being coupled to the electronic device.

18. The method of claim 17, further comprising the timer key exiting the low power sleep mode responsive to receiving an enable signal from the electronic device.

19. The method of claim 18, further comprising the electronic device holding the enable signal high prior to the timer key being coupled to the electronic device.

20. The method of claim 15, further comprising communicating verification data between the electronic device and the timer key to determine whether the timer key is an authorized timer key for the electronic device.

* * * * *